United States Patent [19]

Longsworth

[11] 4,277,949

[45] Jul. 14, 1981

[54] CRYOSTAT WITH SERVICEABLE REFRIGERATOR

[75] Inventor: Ralph C. Longsworth, Allentown, Pa.

[73] Assignee: Air Products and Chemicals, Inc., Allentown, Pa.

[21] Appl. No.: 51,462

[22] Filed: Jun. 22, 1979

[51] Int. Cl.[3] ..... F17C 13/00

[52] U.S. Cl. ..... 62/54; 62/514 R; 165/104.27

[58] Field of Search ..... 62/45, 54, 514 R; 165/105

[56] References Cited

U.S. PATENT DOCUMENTS

| | | | |
|---|---|---|---|
| 2,458,894 | 1/1949 | Collins | 62/178 |
| 3,360,955 | 1/1968 | Witter | 62/514 R |
| 3,538,714 | 11/1970 | Kling et al. | 62/54 |
| 3,620,029 | 11/1971 | Longsworth | 62/6 |
| 3,728,868 | 4/1973 | Longsworth | 62/222 |
| 3,850,001 | 11/1974 | Locke | 165/105 |
| 3,854,454 | 12/1974 | Lazaridis | 165/105 |
| 3,894,403 | 7/1945 | Longsworth | 62/55 |
| 3,949,565 | 4/1976 | Roop | 165/105 |
| 4,027,728 | 6/1977 | Kobayashi et al. | 165/105 |

*Primary Examiner*—Ronald C. Capossela

*Attorney, Agent, or Firm*—James C. Simmons; E. Eugene Innis

[57] ABSTRACT

A cryostat including a source of refrigeration disposed within an evacuated chamber containing a reservoir of liquified cryogen wherein refrigeration is directed to heat stations disposed in the access means to the reservoir to intercept heat leak into said reservoir and to recondense cryogen boil-off from said reservoir. Thermal convective couplings are used to cool the heat stations and to minimize heat leakage in the event the refrigeration source is disabled. Cryogen boil-off is condensed in an apparatus utilizing low thermal conductive conduits to direct the vapors to a refrigeration zone and return the condensed cryogen to the reservoir.

11 Claims, 3 Drawing Figures

83
84
50
52
68
54
72
74
76
78
44
10
22
20
72
56
42
58
32
18
12
28
24
46
60
61
82
34
30
26
62
48
64
70
66
36
80
38
14
40
16

132
128
126
36
136
134
124
120
130
140
127
122

104
92
100
102
90
32
110
96
94
112
106
98
108

CRYOSTAT WITH SERVICEABLE REFRIGERATOR

BACKGROUND OF THE INVENTION

1. Field of the Invention

This invention relates to cryostats utilized to produce and maintain an inventory of a liquified cryogen such as helium. The inventory of liquified cryogen can be used as a low temperature environment for such things as infra-red detectors and super-conducting devices. Such devices require extremely low temperature environments for efficient operation. Temperatures on the order of 4.2 degrees Kelvin (K.) (−268.9 degrees C.) are necessary to maintain helium in the liquified state. Without supplementary refrigeration a bath of liquid helium would, due to heat infiltration even in the best insulated Dewar, boil off and be lost. Attempts have been made to combine a refrigerator with a reservoir or Dewar to prevent excessive loss of liquid helium and thus maintain the overall level of inventoried helium.

2. The Prior Art

Cryostats for producing and maintaining an inventory of a liquified cryogen such as helium range from miniature systems such as disclosed in U.S. Pat. No. 3,728,868 to large systems such as shown in U.S. Pat. Nos. 2,458,894 and 3,360,955.

The miniature system of the '868 patent employs a source of high-pressure gas cooled through heat exchange and expanded through a Joule-Thompson valve to provide a small inventory of liquid helium at the bottom of a glass Dewar.

The '894 patent discloses a system employing one or more expansion engines and multi-stage heat exchangers combined with Joule-Thompson expansion valves to produce liquid helium for use in heat exchange with air to liquify the air for subsequent fractional distillation to produce, inter alia, oxygen.

The '955 patent also employs one or more expansion engines, multi-stage heat exchangers, and Joule-Thompson expansion valves to produce liquid helium to cool various types of electrical apparatus including super-conducting devices.

In relation to super-conducting electronic devices such as super-conducting magnets, super-conducting quantum interference devices and Josephson Junction Devices, applicant in copending application Ser. No. 17,009 filed Mar. 2, 1979 discloses a cryostat wherein the refrigerator can be removed from the vacuum housing, for routine maintenance or in the event the refrigerator malfunctions, without disturbing the vacuum. As pointed out in the copending application, it is desirable to have a cryogenic refrigerator as part of the cryostat so that possible points of heat infiltration (e.g. neck tube accessing the liquid cryogen inventory) can be cooled to prevent heat infiltration and to recondense normal cryogen boil-off from the liquid reservoir.

One cryogenic refrigerator ideally suited for this application is sold as a DISPLEX Model CS-308 Closed Cycle Helium Refrigeration System by Air Products and Chemicals, Inc., Allentown, Pennsylvania. U.S. Pat. No. 3,620,029 discloses in its specification the displacer-expander refrigerator portion of the model CS-308 refrigeration system. This type of refrigerator has been used in many applications. In Mossbauer Spectroscopy it is essential to isolate the sample holder from vibration. Therefore, non-contact transfer of refrigeration by circulating gas as disclosed in U.S. Pat. No. 3,894,403 was developed for use in precision instruments to cool sample holders.

SUMMARY OF THE INVENTION

Applicant's copending application describes a method and apparatus for servicing a cryogenic refrigerator disposed inside a vacuum chamber by removing the entire refrigerator from the chamber.

In order to provide a system wherein the refrigerator can be serviced without removing it from the evacuated chamber, in the event that only the moving parts need service, the cold end portion of the refrigerator including the associated heat exchangers and Joule-Thompson expansion valve are permanently fixed for projection into the evacuated chamber. Thus, if the moving parts of the refrigerator need service, they can be serviced without removing the entire refrigerator from the evacuated chamber.

Refrigeration produced inside the evacuated chamber is used to cool heat stations disposed in the access way to the liquid helium reservoir to minimize heat infiltration to the liquid helium reservoir. The heat stations are cooled by convective couplings which include a source of fluid (e.g. helium) under pressure which is caused to circulate around a closed path by cooling a portion of the convective coupling so that cool gas will fall to the bottom and force warmer gas up toward the refrigeration source. In the event the refrigerator is turned off, the cooler gas in the thermal coupling will sink to the bottom of the thermal coupling, gas will stratify in the coupling and the coupling will act as a thermal switch. The coupling has a characteristic of being a passive thermal disconnect.

Cryogen boil-off is controlled by providing means to condense the boil-off and return the same to the liquid reservoir. Such means includes elongated low thermally-conductive paths to both direct the boil-off to the condenser and return the condensed cryogen to the reservoir.

DESCRIPTION OF THE PREFERRED EMBODIMENTS

Figure 1:
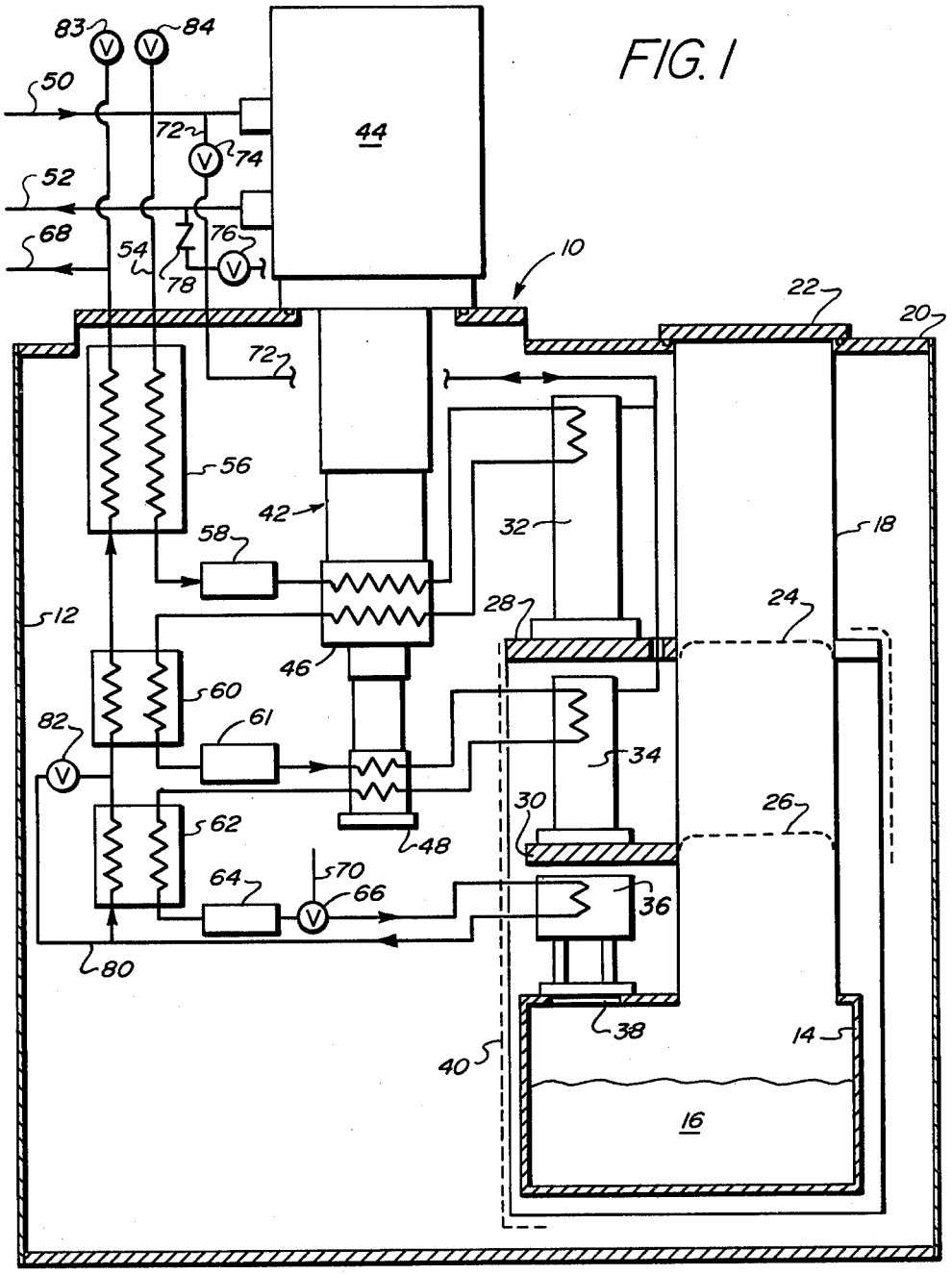
FIG. 1 is a schematic representation of an apparatus according to the invention.

Referring to FIG. 1, the Cryostat 10 includes a vacuum housing 12 which may be a double-walled construction as is well known in the art. Housing 12 includes suitable (not shown) means for evacuating its interior.

Disposed within the housing 12 is a reservoir 14 adapted to store an inventory of liquified cryogen (e.g. helium) 16. Reservoir 14 includes a neck or access way (tube) 18 which is affixed to the top 20 of housing 12 and includes a removable cover 22 so that super-conducting devices can be passed into the liquid cryogen 16 from outside of the cryostat 10. The reservoir 14 and access way 18 are preferrably constructed of low thermal conducting material. Reservoir 14 can be of a double-walled construction as is well known in the art. Disposed within access way 18 are a heat stations 24, 26 adapted to prevent heat infiltrating from outside the cryostat 10 toward the liquid inventory 16. The heat stations 24, 26 are made from a perforated high thermal conductivity material (e.g. copper) to permit gas to expand and contract in the access tube 18. Thermally connected to heat stations 24 and 26 are adapters 28 and 30 for receiving thermal couplings 32 and 34 respectively, the details of which will be disclosed hereinafter.

Helium condenser 36 is affixed to reservoir 14 so that an aperture 38 in reservoir 14 will permit normal helium boil-off vapors to pass into condenser 36 so that the vapors can be recondensed to liquid helium and liquid helium conducted back into the reservoir as will hereinafter be more fully explained.

Surrounding reservoir 14 and a major portion of access tube 18 is one or more radiation shields, shown schematically as 40, to aid in preventing heat infiltration to the liquid cryogen 16 by radiation.

Generally parallel to access way 18 is the cold end 42 of a refrigerator 44. Cold end 42 of refrigerator 44 includes a first stage 46 capable of producing refrigeration at approximately 60° degrees K. (−213° C.) and a second stage 48 capable of producing refrigeration at approximately 15° degrees K. (−258° C.). The refrigerator 44 includes a high-pressure inlet line 50 for admitting high-pressure fluid, e.g. helium, in gaseous form to the refrigerator and an outlet line 52 for removing warm fluid at lower pressure. Inlet line 50 is adapted to admit high-pressure fluid (e.g. helium) through conduit 54 into a first heat exchanger 56 then through a first adsorber 58 in heat exchange with the first stage 46 of refrigerator 44 through heat station 32 back across the first stage 46 of refrigerator 44 into heat exchanger 60 through second adsorber 61 across second stage 48 of refrigerator 44 through thermal coupling 34 back across second stage 48 of refrigerator 44 through a third heat exchanger 62 through a third adsorber 64 through a Joule-Thompson valve 66 through helium condenser 36 then outwardly through the heat exchangers 62, 60 and 56 and conduit 68 for recovery and recycle as with the outlet fluid of conduit 52.

The adsorbers 58, 61, and 64 are used to purify the incoming helium gas to prevent residual contaminants from blocking the various conduits. For example, adsorber 58 will cause water and $CO_2$ to freeze out of the helium gas, whereas adsorber 62 will remove oxygen and nitrogen and adsorber 64 will remove neon and hydrogen which may be in the helium gas.

Joule-Thompson valve 66 includes a control stem 70 which can be made to extend outwardly of the housing 12 so that the orifice size of the valve can be varied. Inlet conduit 50 includes a third branch conduit 72 with suitable control valve 74 so that high-pressure fluid can be admitted to thermal coupling 32 and 34 respectively as needed. Conduit 72 includes a purge valve 76 and a pressure relief valve 78.

Heat exchanger 62 includes a bypass conduit 80 on the return (warm) side and bypass valve 82 to control flow through conduit 80. The bypass valve 82 is open only during cool-down of the refrigerator. Below 20° K. (−253° C.) valve 82 must be closed in order for the return fluid to pass through heat exchanger 62 to precool the incoming fluid.

Purge valves 83, 84 are included in the heat exchanger circuit to permit purging of the system during startup or to remove contaminants if such condition should develop during operation of the system.

In operation, the refrigerator and all conduits and all covers for the cryostat 10 are made fluid-tight to housing 12, after an inventory of liquid helium is placed in reservoir 14, refrigerator 44 is activated and high-pressure helium is admitted to the refrigerator and the heat exchangers simultaneously. As refrigerator 44 cools down it produces two levels of refrigeration, are at first stage 46 and a second stage 48. The high-pressure helium flowing in conduit 54 is cooled to the first level of refrigeration at first stage 46 of refrigerator 44 and cools the thermal coupling 32. As the helium exits thermal coupling 32, it is recooled by contact with first stage 46 of the refrigerator 44 conducted through the second heat exchanger 60, second adsorber 62 and cooled to a lower temperature by second stage 48 of refrigerator 44 after which it is used to cool thermal coupling 34. The helium warmed by cooling thermal coupling 34 is again cooled to the temperature of second stage 48 of refrigerator 44 conducted through heat exchanger 62 and expanded in Joule-Thompson valve 66 to produce a liquified helium. The liquified helium is then passed through condenser 36 to recondense helium boil-off and vaporized where the cold revaporized gas is returned through the heat exchangers 62, 60 and 56 to precool the incoming high-pressure gas by heat exchange, as is well known in the art. Refrigeration produced at thermal couplings 32 and 34 produces an equivalent amount of refrigeration at heat stations 24 and 26 to prevent heat infiltration into the liquid cryogen 16 by providing thermal stratification in the access tube 18. Normal helium boil-off in reservoir 14 is recondensed by condenser 36.

Figure 2:
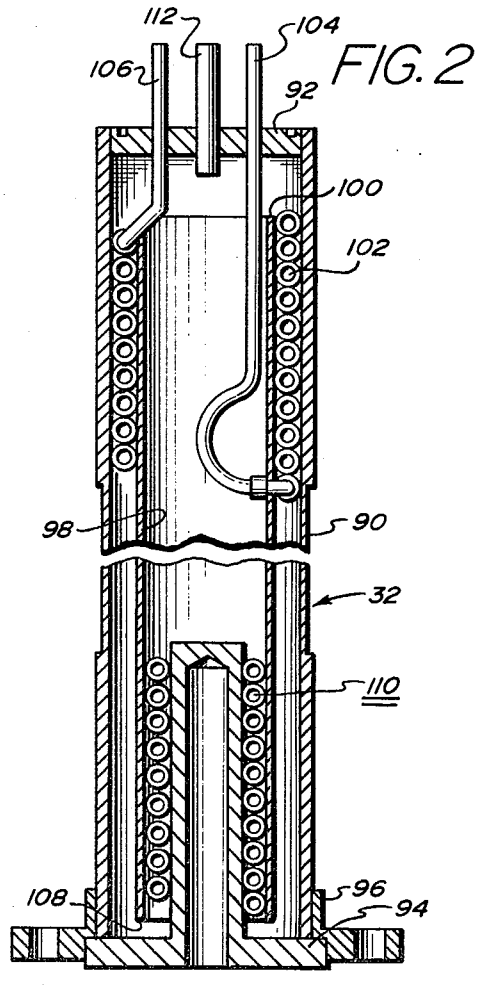
FIG. 2 is a cross-sectional view of a convective coupling suitable for use in the apparatus of FIG. 1.

FIG. 2 shows details of thermal coupling 32 which will illustrate the general structure and operation of both thermal couplings. Thermal coupling 32 includes a housing 90 including a first fluid-tight cover 92 and a second fluid-tight cover 94. Housing 90 also includes a flange 96 or other adapter so that the thermal coupling 32 can be affixed to adapter 28 for thermal contact with heat station 24. Disposed within housing 90 is a chimney or draft tube 98 to provide a circulation path within housing 90. Chimney 98 is of a shorter length than the housing 90 and can be affixed to the housing by any suitable means such as webs, spiders, and the like or the extended surfaces as will hereinafter be more fully described. Disposed around the first or upper end 100 of chimney 98 is a heat exchanger or extended surface apparatus 102 including an inlet conduit 104 and an outlet conduit 106. For thermal coupling 32 conduit 104 is connected to the inlet line from adsorber 58 (FIG. 1) after being cooled by first stage 46 of refrigerator 44 and outlet conduit 106 conducts the warmed fluid back to first stage 46 of refrigerator 44. Disposed adjacent the bottom end 108 of chimney 98 is a second extended surface device 110. Both extended surface device 110 and heat exchanger 102 can be made from finned tubing as is well known in the art. Extended surface 110 could be made from perforated plates, screens, parallel plates and the like, it being only required to have an extended surface for good heat exchange of the circulating gas. In operation, high-pressure working fluid (helium) is admitted through pressurization tube 112. The housing 90 filled with gas and under refrigeration causes the gas in the upper end 92 to become colder than the gas at the bottom end 94, the cold gas falling to the bottom 14 of coupling 32, thus causing warmer gas to rise up the chimney 98. As the warmer gas rises up the chimney, it forces gas over the top end 100 of chimney 98 past heat exchanger coils 102 and down toward the bottom 94 of thermal coupling 32 between the chimney 98 and the housing 32. The cold gas falling toward the bottom 94 causes the bottom plate (end cap) 94 to be cooled to the desired temperature. Housing 90 and chimney 98 are fabricated from materials that are poor thermal conductors, (e.g. stainless steel) whereas bottom plate 94 is fabricated from a good thermal conductor such as copper. The process of warming and cooling and circulation by convection is carried on as long as the refrigeration system is in operation. It is necessary that the warm gas rise up the center in the chimney and the cool gas return or flow between the chimney and the housing 32 to provide effective refrigeration. Therefore, thermal coupling device 32 can only be operated in the vertical position where the refrigeration is produced at the top 92 and the warm fluid rises up through the chimney 98 across extended surface 110. In the event the refrigerator is turned off for service, the cold gas will drop to the bottom of housing 90, the bottom 94 then becoming colder than the top 92, the gas stratifies in the housing 90 and the device acts as a thermal switch. Thus, the device has a characteristic of being a passive thermal disconnect when the refrigerator is shut off.

When the refrigerator 44 is turned off helium boil-off from reservoir 14 has a large heat capacity and further cools heat stations 26 and 24. The cooling of heat station 26 and 24 in turn further cools the bottom ends of thermal coupling 34, 32 preventing heat leak through the couplings to the access way 18.

In order to promote gas circulation, the cold downflowing gas is kept separate from the warm rising gas as explained above. Driving potential is equal to the density difference of the rising gas and the falling gas times the height of the chimney 98. The density difference is a function of gas temperature and the gas pressure. Since mass circulation rate is proportional to pressure, the device can be used as a variable conductance mechanism. Circulation rate is limited by flow friction in the heat exchangers. Couplings, according to the present invention, have been sized for 17 atmospheres internal pressure to operate under the following conditions.

TABLE 1

| Heat Station | First | Second |
|---|---|---|
| Heat Transfer - Watts | 15 | 2 |
| Inlet Gas Temperature °K. | 60.0 | 15 |
| Outlet Gas Temperature °K. | 72.1 | 16.3 |
| Heat Station Temperature °K. | 80.0 | 18.0 |

Figure 3:
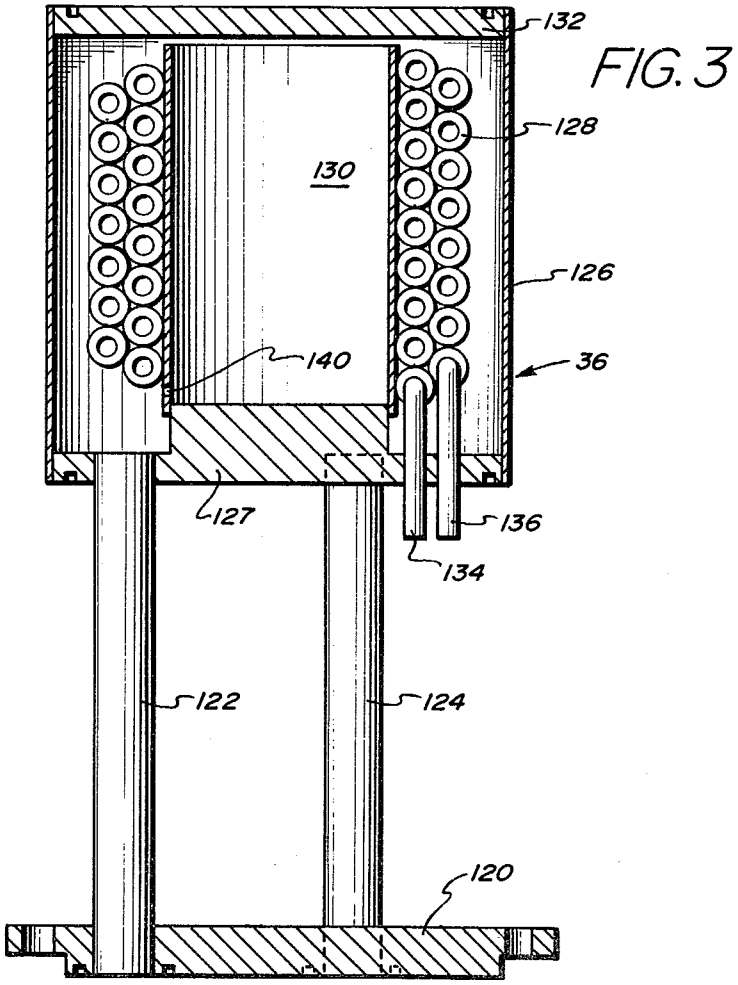
FIG. 3 is a cross-sectional view of a cryogen condenser suitable for use in the apparatus of FIG. 1.

FIG. 3 shows a helium condenser 36 including a mounting plate 120 adapted for fluid-type engagement with aperture 38 in reservoir 14 shown schematically in FIG. 1. Extending through mounting plate 120 are a plurality of heat conducting tubes 122, 124 of low thermal conductivity. The tubes 122, 124 extend through bottom closure 127 of housing 126 and terminate adjacent a heat exchanger 128 disposed around an inner concentric tube 130 fixed to bottom closure 127 of housing 126. Housing 126 is closed by a suitable fluid-tight cover 132. Heat exchanger 128 includes an inlet conduit 134 connected to the output line from the JT valve 66 (FIG. 1) and an outlet conduit 136 to return warmed helium through the heat exchangers 62, 60 and 56. The helium flowing in conduit 134 is at about 4.2 degrees K., thus helium boil-off rising through tubes 122, 124 and striking heat exchanger 128 is recondensed and falls back through tubes 122, 124 into the reservoir 14. Suitable drainholes such as shown as 140 are included in the event liquid helium accumulates inside concentric tube 130 so that it can be returned to the reservoir 14 also. Condenser 36 also serves to isolate the reservoir 14 from thermal conduction in the event the refrigerator is turned off, since the access conduits 122, 124 are of a low thermal conductivity material. The diameter of tubes 122, 124 are selected to avoid accoustical oscillation as is well known in the art.

Referring back to FIG. 1, in the event that the moving parts of the refrigerator 44 have to be serviced, the cold end jacket 42 does not have to be removed from the housing 12 and so the vacuum need not be broken. Those portions of the refrigerator 44 requiring service can be readily removed and serviced.

If the refrigerator shuts down, then flow through the Joule-Thompson loop (56, 58, 60, 61, 62, 64, 66) ceases and the refrigerator is thermally uncoupled from the liquid helium reservoir 14. Thermal couplings 32, 34 will stay cold and in a typical dewar liquid helium would boil off over a period of 10 to 20 days. If the Joule-Thompson loop becomes plugged with contaminants, then it is necessary to warm up the thermal couplings and purge the gas lines. The helium recondenser is designed so it can warm up with only a small heat input into the liquid helium.

With an apparatus according to the invention it is possible to warm up the Joule-Thompson loop (56, 58, 32, 60, 61, 34, 62, 64, 66) to purge it of contaminants such as oil, water, gas, etc. with only a small increase in the boil-off rate of liquid helium, e.g. 0.1 to 1.0 Liquid liters per hour.

A device according to the foregoing description is an improvement over those of the prior art, since it isolates the refrigerator so its moving parts can be removed for service without disturbing the vacuum. There are no moving parts contained within the vacuum envelope and it is possible to thermally isolate the inoperable refrigerator from the liquid helium.

It is also within the purview of the invention to include small heaters with each of the adsorbers 58, 61, 64 to warm the adsorbers if they become plugged.

Having thus described my invention, what is desired to be secured by Letter of Patent of the United States is set forth in the appended claims.

What is claimed is:

1. A thermal coupling interposed between a source of refrigeration and an object to be cooled comprising in combination:

an elongated fluid-tight housing having first and second ends, said first end adapted to mechanically contact a source of refrigeration and said second end adapted to mechanically contact said object to be cooled;

means within said housing having a flow path whereby a fluid in the form of a gas which remains gaseous at the lowest temperature provided by said refrigeration source and disposed within said housing, can when warmed by giving up refrigeration rise from said second end toward said first end where it is cooled and returned to said second end along a separate path without contacting warmed rising gas.

2. A thermal coupling according to claim 1 wherein said first end of said housing includes an extended surface cooled by said refrigeration source.

3. A thermal coupling according to claim 1 wherein said flow path is defined by a chimney within said housing extending from a location adjacent said first end toward a location adjacent said second end whereby warm fluid can rise up said chimney and cooled fluid can flow downwardly between said chimney and said housing.

4. A thermal coupling according to claim 1 wherein an extended surface is disposed adjacent said second end of said housing.

5. A thermal coupling according to claim 1 including means to regulate fluid pressure inside said housing.

6. A condenser for liquifying cryogen boil-off from a reservoir of liquid cryogen comprising in combination:

a chamber including means to contact cryogen boil-off with a source of refrigeration at or below the temperature at which the cryogen will condense;

at least one low heat conductivity conduit adapted to be mounted in fluid-tight relation between a source of cryogen boil-off and said source of refrigeration, whereby said boil-off cryogen is conducted to said source of refrigeration where it is condensed and returned to said reservoir through said low conductivity conduit, said low conductivity conduit being constructed and arranged to minimize heat flow from said refrigeration source to said reservoir in the absence of refrigeration.

7. A condenser according to claim 6 wherein there is a plurality of low conductivity conduits between said reservoir and said source of refrigeration.

8. A condenser according to claim 6 wherein said refrigeration source includes a heat exchanger to contact said cryogen boil-off.

9. A cryostat of the type including a vacuum chamber having disposed therein a liquid cryogen reservoir with access means extending to the outside of said vacuum chamber and refrigeration means within said vacuum chamber to prevent heat infiltration to said liquid cryogen reservoir the improvement comprising:

a closed cycle cryogenic refrigerator mounted on said chamber, said refrigerator having a cold end projecting into said chamber said cold end comprising a sleeve containing a removable refrigeration unit whereby said refrigeration unit can be removed from said sleeve without breaking a vacuum in said chamber;

at least one means disposed in said reservoir access means to intercept heat leaking into said access means from outside said chamber;

pressurized fluid filled means to cool said heat intercepting means; and a recondenser including means for conducting cryogen boil-off from said reservoir to a source of refrigeration for liquification of said cryogen and return to said reservoir.

10. A cryostat according to claim 9 wherein said means to cool said heat intercepting means comprises:

an elongated fluid-tight housing having first and second ends, said first end adapted to mechanically contact said refrigerator and said second end adapted to mechanically contact said object to be cooled;

means within said housing having a flow path whereby a fluid disposed within said housing can, when warmed by giving up refrigeration rise from said second end toward said first end where it is cooled and returned to said second end along a separate path without contacting warmed rising fluid.

11. A cryostat according to claim 9 wherein said means for liquifying cryogen boil-off comprises in combination:

a chamber including means to contact cryogen boil-off with a source of refrigeration at or below the temperature at which the cryogen will condense;

at least one low-heat conductivity conduit adapted to be mounted in fluid-tight relation between a source of cryogen boil-off and said source of refrigeration, whereby said boil-off cryogen is conducted to said source of refrigeration where it is condensed and returned to said reservoir through said low conductivity conduit.

* * * * *